US007266949B2

(12) United States Patent
Jeuch et al.

(10) Patent No.: US 7,266,949 B2
(45) Date of Patent: Sep. 11, 2007

(54) INSULATION OF A SELF-COOLING BEVERAGE PACKAGE

(75) Inventors: Pierre Jeuch, Saint-Aubin (FR); Fadi Khairallah, Versailles (FR)

(73) Assignee: Thermagen SA, Gif sur Yevette (FR)

( * ) Notice: Subject to any disclaimer, the term of this patent is extended or adjusted under 35 U.S.C. 154(b) by 556 days.

(21) Appl. No.: 10/501,937

(22) PCT Filed: Dec. 18, 2002

(86) PCT No.: PCT/IB02/05496

§ 371 (c)(1),
(2), (4) Date: Aug. 18, 2004

(87) PCT Pub. No.: WO03/059779

PCT Pub. Date: Jul. 24, 2003

(65) Prior Publication Data

US 2005/0103026 A1 May 19, 2005

(30) Foreign Application Priority Data

Jan. 18, 2002 (FR) ..... 02 00577

(51) Int. Cl.
*B65B 63/08* (2006.01)

(52) U.S. Cl. ..... 62/60; 62/94; 62/101; 62/480

(58) Field of Classification Search ..... 62/60, 62/94, 101, 112, 434, 467, 476, 479, 480, 62/481, 483

See application file for complete search history.

(56) References Cited

U.S. PATENT DOCUMENTS

| | | | | |
|---|---|---|---|---|
| 4,559,790 | A * | 12/1985 | Houston | 62/259.3 |
| 4,949,549 | A * | 8/1990 | Steidl et al. | 62/101 |
| 5,048,301 | A * | 9/1991 | Sabin et al. | 62/101 |
| 5,079,932 | A * | 1/1992 | Siegel | 62/293 |
| 5,168,708 | A * | 12/1992 | Siegel | 62/4 |
| 5,230,216 | A * | 7/1993 | Siegel | 126/263.01 |
| 5,233,836 | A * | 8/1993 | Siegel | 62/4 |
| 6,234,861 | B1 | 5/2001 | Ichii et al. | |
| 6,341,491 | B1 * | 1/2002 | Paine et al. | 62/4 |
| 6,968,711 | B2 * | 11/2005 | Smith et al. | 62/371 |

FOREIGN PATENT DOCUMENTS

| | | | |
|---|---|---|---|
| DE | 3319664 | A1 * | 12/1984 |
| EP | 0 726 433 | A1 | 8/1996 |
| EP | 1 055 919 | A1 | 11/2000 |
| FR | 2 811 412 | A1 | 1/2002 |
| WO | WO 01 10738 | A | 2/2001 |

* cited by examiner

*Primary Examiner*—Mohammad M. Ali
(74) *Attorney, Agent, or Firm*—Sughrue Mion, PLLC

(57) ABSTRACT

A self-cooling beverage package having a first cavity (10) containing a beverage for consumption, a second cavity (20) forming a heat exchanger and containing a refrigerant liquid and its vapor, a third cavity (30) containing means of pumping by adsorption of said vapor and means (50) of putting said second cavity into communication with said third cavity, characterised in that the third cavity (30) has an external thermal insulation layer (35).

16 Claims, 2 Drawing Sheets

INSULATION OF A SELF-COOLING BEVERAGE PACKAGE

Figure 1:
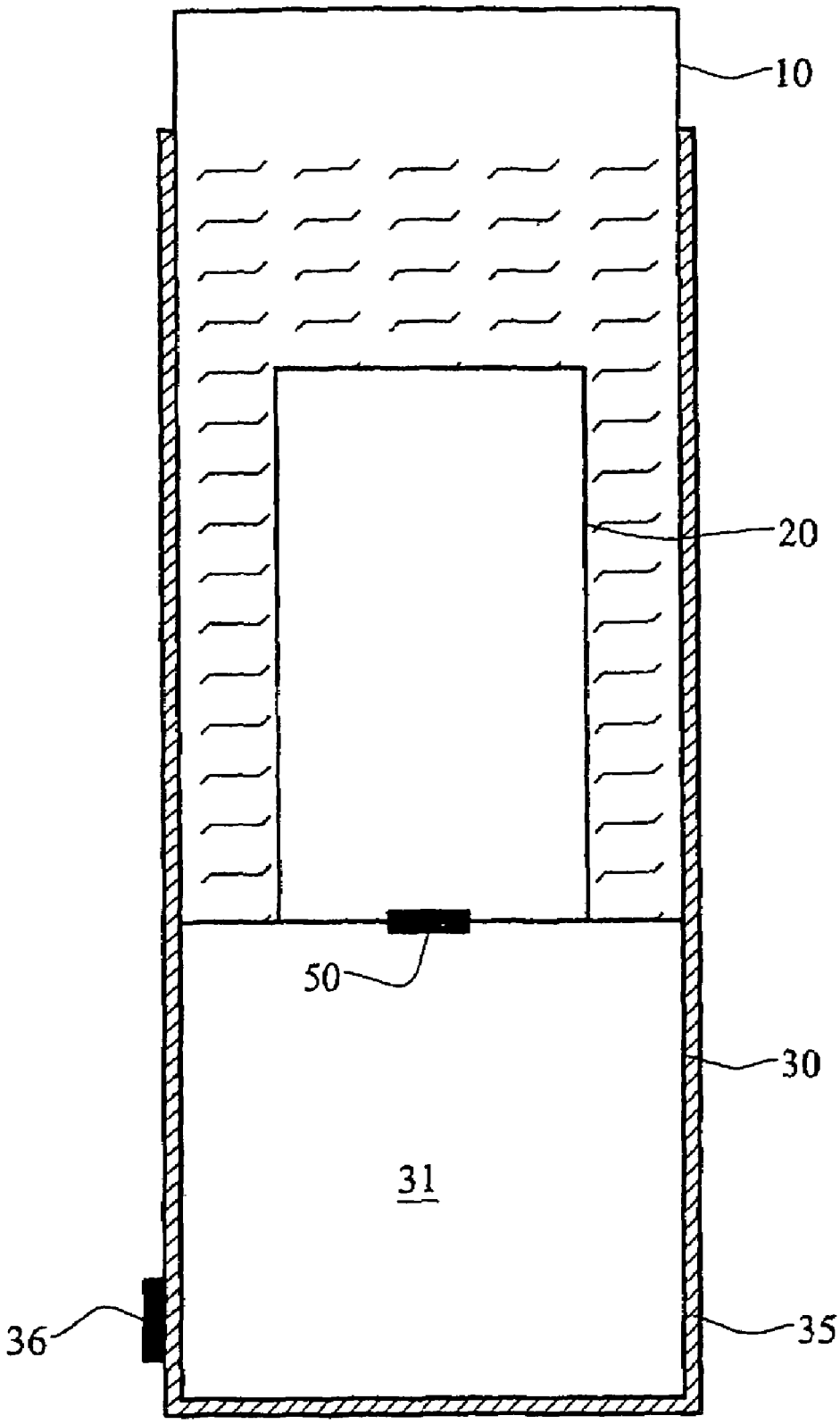

The present invention relates to a beverage package device allowing cooling of its contents by sorption cooling method. The principle of such a cooling method consists of evaporating a liquid under the effect of a partial vacuum maintained by pumping the vapours of said liquid. The invention is applicable most particularly to the cooling of a beverage contained in a can or bottle type closed package.

The object of the present invention is thus to allow the consumption of a beverage at an ideal temperature anywhere and at any time.

The implementation of the method of sorption cooling is known and has been the subject of much research in the prior art. Many devices have been proposed, associating a heat exchanger containing a refrigerant liquid to be evaporated with a cavity containing an adsorbent, in particular for applications to self-cooling beverage packages.

One of the difficulties of implementing such a method of sorption cooling consists of managing the heat deposited in the adsorbent during the adsorption reaction. This is because, when the adsorbent, generally a desiccant such as zeolites, adsorbs the vapor of the refrigerant liquid, it heats up and therefore loses most of its adsorption capacity. Removing part of this heat deposited in the dessicant improves significantly the cooling performances of the device.

Various solutions for limiting the rise in temperature of the adsorbent have already been proposed in the prior art.

A first known solution, described in the patent U.S. Pat. No. 4,759,191, consists of removing the heat deposited in the adsorbent (a desiccant) by means of a heat sink consisting of a material in thermal contact with the desiccant, said material having either a solid-to-liquid phase change, or a high heat capacity, or an endothermic reaction. The patent U.S. Pat. No. 4,949,549, from the same inventors, specifies the solution adopted, namely a material with a phase change such as sodium acetate, the solid-to-liquid phase change of which is situated at 58° C. This solution nevertheless requires the implementation of a particular container for the associated phase change material in the desiccant container, which complicates the method of manufacture of such self-cooling beverage packages because it requires efficient thermal coupling between the dessicant and the heat sink material.

An adaptation of this solution, described in the patent U.S. Pat. No. 5,048,301, consists of thermally insulating the adsorbent with the heat sink in an evacuated chamber inside the beverage can. Nevertheless, this solution is complex to implement.

Patent application WO 01/10738 also describes a self cooling can using a sorption cooling method with a heat sink material. Since the phase change of the heat sink material occurs around 60° C., the dessicant and the heat sink material are packaged in an insulating container to protect the consumer from the hot material.

Another known solution, described in the patent U.S. Pat. No. 4,928,495, proposes storage of the heat deposited in the adsorbent (a desiccant) in water, the heat capacity of which is relatively high. An alternative, described in the same patent, consists of wetting the external surface of the desiccant container in order to remove the calories by evaporation of this water wetting the desiccant container. Nevertheless, the implementation of such a device is complex and protection against burns is no longer provided once the water wetting the external surface of the container has totally evaporated.

Another solution, described in the patent application FR 2 811 412, consists of disposing thermal insulation at the periphery of a block of desiccant, inside the container containing said desiccant. This insulation is constituted by zeolites impregnated with resin in order to obstruct their porosity and prevent them adsorbing the vapours of the refrigerant liquid. By preventing the zeolites fulfilling their adsorption function, their heating up is prevented.

The objective of the present invention is to propose an alternative solution to managing the heat deposited in the adsorbent during implementation of the sorption cooling method as described previously.

The simplest solution would be to let the adsorbent heats up to its equilibrium temperature and to provide enough adsorbent to achieve the proper cooling performance. The adsorbent for pumping the refrigerant liquid vapor advantageously consists of a dessicant such as a zeolite 13× for example. During the adsorption of water vapor by such a zeolite, the adsorbent can reach 200° C. for an adsorption capacity of around 5% by mass of adsorbed water with respect to the mass of the desiccant. Thus, around 200 g of zeolite are sufficient to adsorb 10 g of water, the evaporation of which makes it possible to cool 330 ml of beverage by 15° C. It is therefore not essential to remove the heat deposited in the desiccant since the adsorption capacity limit is not reached.

With such a solution, the major difficulty is to provide the proper insulation for the heated adsorbent (about 200° C. for zeolites). Two problems must be considered:

- avoid heating of the cooled beverage by heat flowing back from the adsorbent to the evaporator and beverage can;
- avoid excessive external temperature of the adsorbent container for consumer safety and comfort.

To this end, the present invention proposes an insulation layer design disposed around the adsorbent container which compels these two problems.

More particularly, the invention relates to a self-cooling beverage package device having a first cavity containing a beverage for consumption, a second cavity forming a heat exchanger and containing a refrigerant liquid and its vapor, a third cavity containing adsorbent for pumping of said vapor and means of putting said second cavity into communication with said third cavity for operation of the device, characterised in that the third cavity has an external thermal insulation layer designed such that the heat flow from the adsorbent through the outside wall of the third cavity is larger or equal to the heat flow from the adsorbent to the second and first cavities during operation of the device.

According to one embodiment, the temperature of the external surface of the insulating layer rises to more then 70° C. during operation of the device.

According to one characteristic, the thermal insulation layer has a thermal conductivity less than or equal to 500 $W.m^{-2}.K^{-1}$, and preferentially between 20 and 60 $W.m^{-2}.K^{-1}$.

According to another embodiment, the thermal insulation layer includes a material melting at a temperature between 40° C. and 80° C. Possibly, the thermal insulation layer consists of at least two layers, one of them including the melting material.

According to embodiment, the thermal insulation layer surrounds the third cavity consisting of a metal container or the thermal insulation layer is constituted by the walls of a container forming the third cavity.

According to one embodiment, the thermal insulation layer extends around the first cavity.

According to one embodiment, the thermal insulation layer has a thermochromic label.

Figure 2:
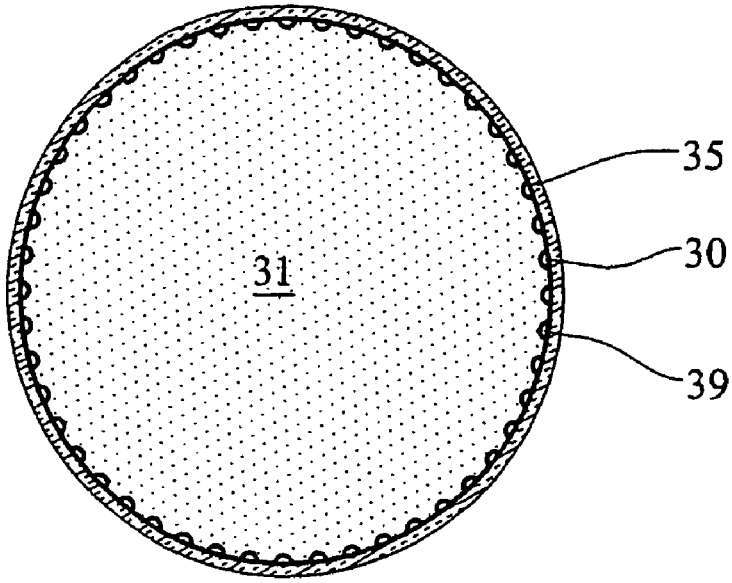
Figure 3:
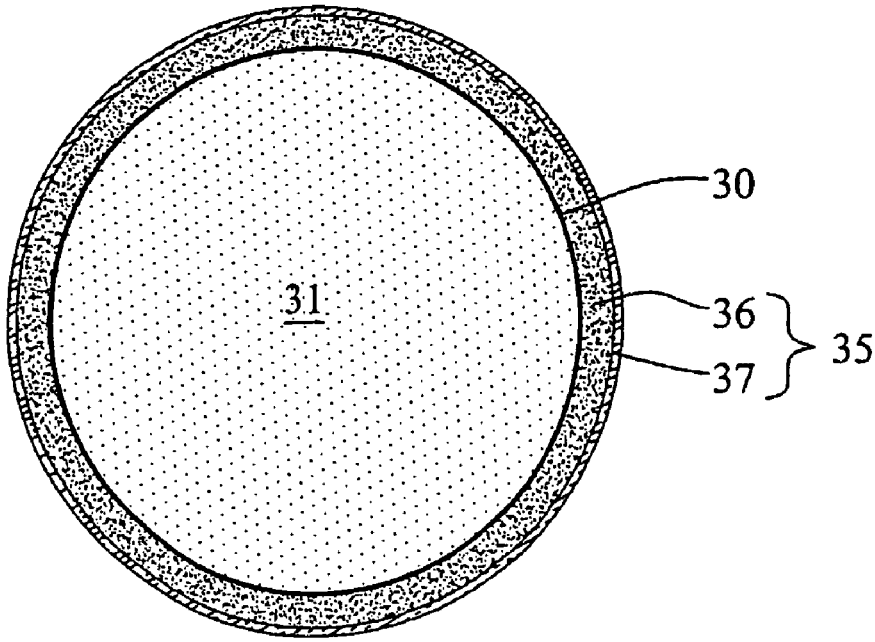

The features and advantages of the present invention will emerge in the course of the following description given by way of an illustrative and non-limitation example, and produced with reference to the accompanying figures in which:

FIG. 1 is depicting a self-cooling beverage package according to the invention, FIG. 2 is depicting the insulation layer according to one embodiment of the invention, FIG. 3 is depicting the insulation layer according to another embodiment of the invention.

Referring to FIG. 1, the self-cooling beverage package according to the invention has a first cavity 10 containing a beverage for consumption, a second cavity 20 forming a heat exchanger and containing a refrigerant liquid, such as water, and its vapor and a third cavity 30 containing dessicant 31 for pumping by adsorption of said vapor. The second cavity 20 is also referred to as the evaporator and the third cavity 30 is also referred to as the desiccant container. Means 50 of putting said second cavity 20 into communication with said third cavity 30 are also provided for operation of the sorption cooling method.

The third cavity 30 consists of a container guaranteeing good vacuum sealing necessary for correct operation of the pumping means. Generally, this container is metallic. The risk of burning therefrom is all the higher. Thus, according to the invention, the third cavity 30 has a thermal insulation layer 35.

According to the present invention, the first previously identified problem (avoid heating of the cooled beverage by heat flowing back from the adsorbent container to the evaporator) is solved by an active heat shield concept which mainly works as follow:

As heat leaks out of the adsorbent 31, it cools down and consequently is capable of adsorbing more refrigerant vapor, resulting in additional cooling in the evaporator 20. In case of zeolites used as adsorbent, this additional cooling is about or above 50% of the heat leakage out of the adsorbent. The insulation layer 35 surrounding the dessicant container 30 is designed such that the heat flow from the adsorbent through the outside wall of the third cavity is at least as large as the heat flow towards the evaporator and the beverage can (respectively second 20 and first 10 cavities). With such insulation, the net effect is additional cooling of the beverage and not heating by dessicant heat.

Moreover, the second previously identified problem (avoid excessive external temperature of the adsorbent container for customer safety and comfort) is also solved by the insulation layer according to the invention.

According to one preferred solution, the thermal insulation layer 35 is provided with a conductivity adjusted to achieve an outer surface of said insulation layer to reach 70° C. and up to 90° C. during the sorption cooling process. This relatively high external surface temperature allows extracting about 0.1 $W.cm^{-2}$ through natural convection. However, this external surface temperature falls down to about 40-45° C. on contact with fingers. This temperature drop on contact with a consumer fingers is due to the higher heat extraction by fingers as compared to the natural air convection (about three times more) combined with the high thermal gradient across the insulation layer which ranges from 20° C. to 50° C.

This natural convection increases the absorption capacity of the desiccant and advantageously contributes towards prolonging the beverage cooling process. The heat power extracted, of the order of a few watts, is not a determining factor for the initial cooling of the beverage which is typically 15° C. in 3 minutes, but it provides additional cooling over a much longer period, typically 2° C. in 30 minutes, in order to keep the beverage cool during its consumption.

The thermal conductivity of the insulation layer that achieves these conditions is less then 100 $W.m^{-2}.K^{-1}$ and preferably ranges from 20 to 60 $W.m^{-2}.K^{-1}$.

The temperature distribution (from inside the desiccant material 31, at the adsorbent container wall 30, to outside the external insulation 35) can also be influenced by the heat coupling between the desiccant 31 and the container wall 30 by providing an additional insulation inside the container.

Such internal insulation can be achieved by a method described in previously cited patent application FR 2 811 412, or by an adequate geometrical structuring of the desiccant 31 close to the wall of the container 30, such as ripples 39 as illustrated FIG. 2.

In this embodiment, the desiccant container wall 30 equilibrium temperature is lowered and the required conductivity of the external insulation layer 35 must be higher to achieve the needed heat flow to the outside atmosphere. In this configuration, the conductivity of the external insulation layer 35 ranges from 100 to 500 $W.m^{-2}.K^{-1}$. Since the desiccant container walls temperature is lowered, the heat flow towards the beverage can and the evaporator (first 10 and second 20 cavities) is reduced.

According to an alternative solution, an illustration of which is given FIG. 3, the insulation layer 35 includes a material melting at a temperature between 40° C. and 80° C. This phase change material provides an active heat shield between the dessicant container 30 and the outside atmosphere such that the energy transmitted to the outside atmosphere is less than the energy flowing out of the dessicant container. The difference of energy corresponds essentially to the latent heat of the melting material. According to this embodiment, the insulation layer 35 consists of at least two layers 36, 37, one of them 36 including the melting material. A typical material that can be incorporated in the insulation layer 36 is Sodium Acetate trihydrate melting at 58° C. An additional layer 37 of insulation without melting material is required to act as an thermal protection. This additional layer 37 has a thermal conductivity less than 100 $W.m^{-2}.K^{-1}$, typically 50. The phase change material can be incorporated in voids of the insulation layer 36.

The thermal insulation layer 35 is surrounding the metallic third cavity 30 and can be constituted by a layer of cardboard and/or a number of layers of superposed paper and/or a plastic. It can be glued on the external surface of the third cavity 30 or be held by a heat-shrink plastic tube. It typically has a thickness between 0.5 and 1.5 mm in the first described embodiment and can reach 3 to 5 or even 10 mm in the embodiment including melting material. The thermal insulation layer is advantageously put in place after the filling of the beverage, in particular in the case of pasteurised beverages where it is put in place after pasteurisation.

The heat leakage through the can wall of the beverage can (first cavity 10) produces a thermal gradient along the adsorbent container wall 30. To optimise the heat leakage to the outside atmosphere while keeping adequate protection for the consumer, the insulation layer 35 thickness can be reduced as it gets closer to the boundary between the beverage can 10 and the adsorbent container 30.

According to one particular embodiment, the thermal insulation layer 35 can extend from the third cavity 30 containing the desiccant to the first cavity 10 containing the beverage for consumption. It can thus contribute towards keeping the beverage cool during its consumption.

According to one embodiment, the thermal insulation layer 35 has a thermochromic label 36, for example by printing of thermochromic ink directly on said insulating layer. This printing can be implemented opposite the desiccant container 30, for example on the hottest part of the self-cooling package. The appearance of the thermochromic ink at a given temperature threshold, for example at 60° C., can constitute an indicator of correct operation of the self-cooling device.

It can also be envisaged disposing the thermochromic label opposite the cavity 10 containing the beverage for consumption and which will be activated below a certain threshold, for example 10° C., in order to constitute an indicator for ideal consumption of the beverage.

One possible alternative consists of implementing the thermal insulation layer 35 directly by the walls of a container forming the third cavity 30.

The present invention provides self-cooling beverage packages with an effective physiological protection against the risks of burning due to the rise in temperature of the adsorbent. In order to achieve an equivalent protection situated inside the metal adsorbent container, thermal insulation would have to have a thermal resistance five times greater, requiring more volume in the device and more material.

The thermal insulation layer according to the invention allows the use of an efficient adsorbent such as a zeolite without requiring recourse to heat sink which considerably complicate the manufacture of the device.

Moreover, the thermal insulation layer according to the invention makes it possible to naturally continue the cooling process and thus provides an addition to the initial rapid cooling in order to keep the beverage cool during its consumption.

The invention claimed is:

1. A self-cooling package device having:

a first cavity containing a product for consumption, a second cavity forming a heat exchanger and containing a refrigerant liquid and its vapor, a third cavity having an outside wall and containing adsorbent for pumping of said vapor, and means for putting said second cavity into communication with said third cavity for operation of the device, wherein the third cavity is provided with an external thermal insulation layer providing a physiological protection against burns and designed such that the heat flow from the adsorbent through the outside wall of the third cavity and through the external insulation layer is larger or equal to the heat flow from the adsorbent towards the second and first cavities during operation of the device.

2. A self-cooling package according to claim 1, wherein the temperature of the external surface of the insulation layer rises to more than 70° C. during operation of the device.

3. A self-cooling package according to claim 1, wherein the thermal insulation layer has a thermal conductance less than or equal to 500 $W.m^2.K^{-1}$.

4. A self-cooling package according to claim 3, wherein the thermal conductance of the insulating layer is between 20 and 60 $W.m^2.K^{-1}$.

5. A self-cooling package according claim 1, wherein the thermal insulation layer has a thickness between 0.5 and 1.5 mm.

6. A self-cooling package according to claim 1, wherein the thermal insulation layer has a variable thickness.

7. A self-cooling package according to claim 1, wherein the thermal insulation layer includes a material melting at a temperature between 40° C. and 80° C.

8. A self-cooling package according to claim 7, wherein the thermal insulation layer comprises at least two layers, one of them including the melting material.

9. A self-cooling package according to claim 7, wherein the thermal insulation layer has a thickness between 3 and 10 mm.

10. A self-cooling package according to claim 1, wherein the thermal insulation layer surrounds the third cavity consisting of a metal container.

11. A self-cooling package according to claim 1, wherein the thermal insulation layer extends around the first cavity.

12. A self-cooling package according to claim 1, wherein the thermal insulation layer has a thermochromic label.

13. A self-cooling package according to claim 12, wherein the thermochromic label is disposed opposite the third cavity.

14. A self-cooling package according to claim 12, wherein the thermochromic label is disposed opposite the first cavity.

15. A self-cooling package according to claim 1, wherein the thermal insulation layer comprises cardboard and/or paper and/or plastic.

16. A method for cooling the content of a package, comprising the steps of:

providing a package having a first cavity containing a product to be refrigerated, a second cavity forming a head exchanger and containing a refrigerant liquid and its vapor, and a third cavity having an outside wall and containing adsorbent, said third cavity being provided with an external thermal insulation layer;

putting into communication said third cavity with said second cavity;

cooling down the product within said first cavity by pumping vapor of said refrigerant liquid by said adsorbent;

avoiding heating back of cooled product within said first cavity by allowing the heat flow from the adsorbent through the outside wall of the third cavity and through the external thermal insulation layer to be larger or equal to the heat flow from the adsorbent towards the second and first cavities; and avoiding excessive external temperature of the third cavity containing the adsorbent by allowing a thermal gradient across the insulation layer ranging from 20° C. to 50° C.

* * * * *